US010190375B2

(12) United States Patent
Calderoni

(10) Patent No.: US 10,190,375 B2
(45) Date of Patent: Jan. 29, 2019

(54) CONNECTION DEVICE FOR CONNECTING A SECONDARY CIRCUIT TO A DRILLING ELEMENT FOR THE CIRCULATION OF DRILLING FLUIDS IN AN OIL WELL

(71) Applicant: DRILLMEC SPA, Gariga di Podenzano (PC) (IT)

(72) Inventor: Angelo Calderoni, Gariga di Podenzano (IT)

(73) Assignee: DRILLMEC S.P.A., Gariga di Podenzano (PC) (IT)

( * ) Notice: Subject to any disclaimer, the term of this patent is extended or adjusted under 35 U.S.C. 154(b) by 158 days.

(21) Appl. No.: 15/112,993

(22) PCT Filed: Jan. 16, 2015

(86) PCT No.: PCT/IB2015/050324
§ 371 (c)(1),
(2) Date: Jul. 20, 2016

(87) PCT Pub. No.: WO2015/107481
PCT Pub. Date: Jul. 23, 2015

(65) Prior Publication Data

US 2017/0002616 A1 Jan. 5, 2017

(30) Foreign Application Priority Data

Jan. 20, 2014 (IT) ..... TO2014A0030

(51) Int. Cl.
*E21B 21/10* (2006.01)
*E21B 21/12* (2006.01)

(52) U.S. Cl.
CPC ..... *E21B 21/106* (2013.01); *E21B 21/10* (2013.01); *E21B 21/12* (2013.01)

(58) Field of Classification Search
CPC ..... E21B 21/10; E21B 21/106; E21B 21/12
See application file for complete search history.

(56) References Cited

U.S. PATENT DOCUMENTS 8,016,033 B2 9/2011 Iblings et al.
8,033,338 B2 10/2011 Springett
(Continued)

FOREIGN PATENT DOCUMENTS

IT TO20130722 A1 3/2015

OTHER PUBLICATIONS

International Search Report and Written Opinion from corresponding International Patent Application No. PCT/IB2015/050324, dated Jun. 9, 2015, 8 pages.
(Continued)

*Primary Examiner* — David J Bagnell
*Assistant Examiner* — Manuel C Portocarrero
(74) *Attorney, Agent, or Firm* — Merchant & Gould P.C.

(57) ABSTRACT

A connection device for connecting a secondary drilling fluids circuit to a drilling element includes a radial aperture. A central body has a first connection portion forming a sealed connection to the secondary circuit. A second connection portion forms a sealed connection to the radial aperture and an intake duct conducts drilling fluids. A clamping system connects the connection device to the drilling element. One opening device is adapted to selectively open and close the radial aperture by acting upon a valve assembly. One coupling device connects the opening device to the valve assembly. The opening device selectively opens and closes the radial aperture by acting upon an obstructor of the valve assembly through rotary movement. The coupling device couples to a clamping element in the obstructor to transfer the rotary movement of the opening device to the obstructor to selectively and securely open and close the radial aperture.

15 Claims, 13 Drawing Sheets

(56) References Cited

U.S. PATENT DOCUMENTS

| | | | | |
|---|---|---|---|---|
| 2008/0060846 | A1* | 3/2008 | Belcher | E21B 17/042 175/25 |
| 2011/0203848 | A1* | 8/2011 | Krueger | E21B 21/08 175/57 |
| 2013/0068532 | A1 | 3/2013 | Bansal et al. | |

OTHER PUBLICATIONS

International Preliminary Report on Patentability and Written Opinion from corresponding International Patent Application No. PCT/IB2015/050324, dated Jul. 26, 2016, 7 pages.

* cited by examiner

CONNECTION DEVICE FOR CONNECTING A SECONDARY CIRCUIT TO A DRILLING ELEMENT FOR THE CIRCULATION OF DRILLING FLUIDS IN AN OIL WELL

This application is a National Stage Application of International Application No. PCT/IB2015/050324, filed 16 Jan. 2015, which claims benefit of Serial No. TO2014A000030, filed 20 Jan. 2014 in Italy and which applications are incorporated herein by reference. To the extent appropriate, a claim of priority is made to each of the above disclosed applications.

BACKGROUND OF THE INVENTION

The present invention relates to an automatic or semiautomatic connection device for connecting a secondary circuit to a drilling element, for the purpose of allowing circulation of fluids in the well during the entire drilling process.

Such a connection device allows connecting the secondary circuit for the circulation of drilling fluids, which in turn is connected to a collector circuit, to a drilling element comprising at least one radial aperture with which at least one valve assembly is associated, so as to allow the drilling fluids to circulate through said radial aperture as is known to those skilled in the art, in order to allow circulation of drilling fluids also during the steps of adding or removing at least one drilling element to/from the string of drilling elements placed in a wellbore.

The connection device is connected to the end of said secondary circuit for the circulation of drilling fluids.

Connection devices are known which are adapted to connect a secondary circuit to a radial aperture comprised in a drilling element in order to allow for continuous circulation of drilling fluids even when adding or removing at least one drilling element to/from the string of drilling elements placed in the wellbore.

Manual connection devices are known, which are manually secured to the drilling element by an operator working on a drill floor of a drilling rig.

Semiautomatic connection devices are also known, which can automatically perform a number of operations for connecting the secondary circuit to the radial aperture under the supervision of an operator, who still has to carry out some manual operations, such as, for example, removing the safety plug normally associated with the radial aperture.

Automatic systems are also known which can automatically connect the secondary circuit to the radial aperture.

Such connection devices employ automatic devices for removing the safety plug. The automatic connection devices known in the art are very complex due to the fact that they need to remove said safety plug from the radial aperture.

Said connection devices also comprise clamping systems that cannot ensure proper sealing between the connection device and the drilling element in case of variations of a radial dimension, e.g. the outside diameter, of the drilling element to be used in the drilling process.

One example of such a connection device is shown in prior-art documents U.S. Pat. No. 8,033,338 and U.S. Pat. No. 8,016,033. The solutions proposed therein are very complex and require very long times for establishing the connection and allow the circulation of drilling fluids through said radial aperture.

In both solutions described in the above-mentioned patent documents, a very accurate control of the positioning of the radial aperture relative to said connection device is required, thus being hardly applicable to an existing rig. Moreover, because of the complexity of these devices, both solutions require that the mud intake duct be positioned not in alignment with the radial aperture, leading to a number of problems known to those skilled in the art.

Prior-art document US2013068532 describes an automatic connection device comprising an actuating device for lifting a gate-type obstructor comprised in a valve assembly associated with a radial aperture of a drilling element. Said obstructor is adapted to close said radial aperture. In this case as well, the connection device requires a perfect alignment between the radial aperture and the device itself to ensure a proper connection of the device to the drilling element.

The clamping system described in this latter document is not capable of automatically exerting a sealing force on the drilling element also when the radial dimensions of the drilling element change. In this case as well, the presence of an operator is required, who will have to secure the clamping system around the drilling element.

In all of the solutions described in prior-art documents, although substantially linear movements are only made, the handling devices are very complex because of the necessity of removing a safety plug or lifting gates, at any rate requiring the active presence of an operator near the drilling element while connecting or disconnecting the secondary circuit.

All connection devices require an excessively long time for properly connecting the device to the drilling element, in particular for ensuring that the radial aperture will open safely, due to the valve assembly being associated with the radial aperture of the drilling element. In fact, such valve assemblies offer poor performance in terms of safety of opening and closing said radial aperture, which the connection device itself must make up for in order to ensure proper circulation of drilling fluids through said radial aperture.

The high complexity of prior-art connection devices increases the risk of a malfunction and requires longer repair times.

SUMMARY OF THE INVENTION

The connection device according to the present invention aims at solving the above-described problems by providing a connection device, preferably a fully automated one, which can perform, without requiring any human contribution, the step of connecting a secondary duct to a radial aperture located on a drilling element and subsequently releasing it after the step of feeding drilling fluid through the radial aperture has been completed.

One aspect of the present invention relates to a connection device.

A further aspect of the present invention relates to a system comprising a connection device and a valve assembly associated with the radial aperture.

A further aspect of the present invention relates to a drilling rig.

BRIEF DESCRIPTION OF THE DRAWINGS

The features and advantages of the connection device and of the applications thereof will become apparent from the following description of different embodiments of the same device, in particular three of them, and from the annexed drawings, wherein:

FIG. 2A shows the connection device and the drilling element disconnected from each other, whereas FIG. 2B shows the connection device and the drilling element sealingly connected to each other for effecting mud circulation through the radial aperture comprised in the drilling element;

FIG. 3A shows a top view of the connection device, wherein the clamping system is in an open or released configuration; FIG. 3B shows the connection device and the drilling element sealingly connected to each other, wherein the clamping system is in a closed or holding configuration, exerting a force towards said drilling element;

FIG. 4A shows the connection device of FIG. 3B connected to the drilling element, wherein the coupling device and the opening device are both in a non-operating configuration; in FIG. 4B the coupling device is in an operating configuration, wherein the fitting element of the coupling device is connected to the clamping element of the first obstructor; in FIG. 4C the opening device is in an operating configuration, wherein it acts upon said first obstructor through a rotary movement, thereby allowing the drilling fluids to start flowing through said radial aperture;

FIG. 6A shows a top view of the connection device, wherein the clamping system is in an open or released configuration; FIG. 6B shows the connection device and the drilling element sealingly connected to each other, wherein the clamping system is in a closed or holding configuration, exerting a force towards said drilling element;

FIG. 7A shows the connection device of FIG. 6B connected to the drilling element, wherein the coupling device and the opening device are both in a non-operating configuration; in FIG. 7B the coupling device is in an operating configuration, wherein the fitting element of the coupling device is connected to the clamping element of the first obstructor; in FIG. 7C the first opening actuator is in an operating configuration, wherein it rotates said first obstructor, while the second opening actuator is in a non-operating configuration; FIG. 7D shows both opening actuators in an operating configuration, wherein the drilling fluid can start flowing through said radial aperture;

FIG. 9A shows a top view of the connection device, wherein the clamping system is in an open or released configuration; FIG. 9B shows the connection device and the drilling element sealingly connected to each other, wherein the clamping system is in a closed or holding configuration, exerting a force towards said drilling element;

FIG. 10A shows a perspective view of the actuating device, wherein the fitting element is connecting to a clamping element comprised in the first obstructor of the valve assembly; FIG. 10B shows a C-C section of the actuating device in an operating configuration, connecting the fitting element to the clamping element of the first obstructor;

FIG. 11A shows a front view, relative to the radial aperture, of the actuating device and drilling element, whereas FIG. 11B shows a C-C sectional view of the actuating device and drilling element;

FIG. 12A shows a front view, relative to the radial aperture, of the opening device and drilling element, whereas FIG. 12B shows a C-C sectional view of the opening device and drilling element;

FIG. 15A shows the moving system in a retracted configuration, whereas FIG. 15B shows it in an extended configuration.

DETAILED DESCRIPTION

Figure 1:
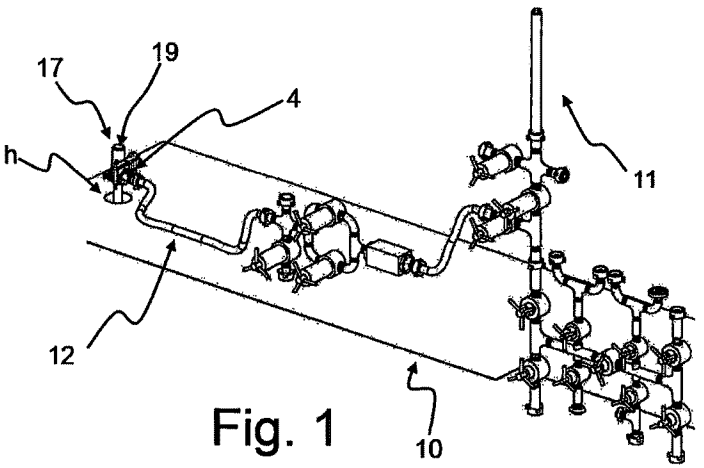
FIG. 1 shows a drilling fluid circulation system wherein a secondary circuit comprises a connection device according to the present invention, connected to a drilling element for connecting the same secondary circuit to a radial aperture comprised in the drilling element, in turn comprising a valve assembly.

With reference to the above-mentioned drawings, connection device 4 according to the present invention is preferably automatic, in particular fully automatic. Connection device 4 is adapted to allow a secondary circuit 12 to be connected to a drilling element 17. In particular, said secondary circuit 12 is used for the circulation of drilling fluids "P", such as drilling mud, in a drilling rig. Said drilling element 17 comprises an axial hole 18 and a radial aperture 19 in communication with said axial hole 18, as is known to a man skilled in the art. With said radial aperture 19 a safety valve assembly 2 is associated, for preventing any drilling fluid to exit through said radial aperture 19 when drilling fluid "P" is flowing in said axial hole 18, as is known to a man skilled in the art. Said connection device 4 allows establishing the circulation of drilling fluids "P", conducted by said secondary circuit 12, through said radial aperture 19 towards the bottom of a drilling well "h", as shown by way of example in FIG. 1. Said connection allows a flow of drilling fluids "P", such as drilling mud, to circulate towards the bottom of a drilling well "h" for drilling rigs during the entire drilling step and also during the steps of connecting and/or removing drilling elements 17, i.e. when it is not possible to have drilling fluids "P" flow in a main circuit 11 through axial hole 18 of drilling element 17, as is known to a man skilled in the art.

In general, said drilling element 17 may be a drill pipe, a tool joint or a clutch, as is known to a man skilled in the art.

Said valve assembly 2, which is associated with a radial aperture 19 of a drilling element 17, and connection device 4 according to the present invention can constitute a system or assembly contributing to the control of the circulation of drilling fluid "P" towards the bottom of drilling well "h", in particular through said radial aperture 19, in a safe manner, so as to reduce the risks for the personnel working on the drilling rig.

For the purposes of the present invention, said valve assembly 2 comprises a valve body 21 and at least one obstructor (22, 24), preferably two. Said at least one obstructor is adapted to take at least two operating configurations, in order to selectively allow the opening and closing of said radial aperture 19, in particular a first operating configuration for closing the valve with which it is associated, and a second operating configuration for opening the same valve.

Connection device 4 according to the present invention comprises: a central body 42, in turn comprising a first connection portion 43 providing a tight connection to said secondary circuit 12, e.g. by means of hammer joints, or by means of fastening means known to those skilled in the art; a second connection portion 44 providing a tight connection to said radial aperture 19, as will be illustrated in detail in the course of the present description.

Between said first connection portion 43 and said second connection portion 44 an intake duct 41 is interposed for conducting drilling fluid "P".

In general, secondary circuit 12 connected to collector circuit 10 consists of at least one high-pressure hose, as is known to a man skilled in the art.

Said drilling fluid "P", coming from the drilling fluid circulation circuit, is diverted, by means of a collector circuit 10, from a main circuit 11 to said secondary circuit 12 in order to feed drilling fluid "P" into the string of drilling elements 17 the drilling well "h", through the radial aperture 19 of drilling element 17 in, thus reaching the well bottom.

Connection device 4 further comprises a clamping device 5 for ensuring a proper connection between connection device 4 and drilling element 17.

Connection device 4 according to the present invention comprises a single opening device 7, which is adapted to selectively open and close, at least partially, radial aperture 19 of drilling element 17 by acting upon valve assembly 2.

For the purposes of the present invention, the phrase "opening device 7 adapted to selectively open and close, at least partially, radial aperture 19 by acting upon valve assembly 2" means that said opening device 7 can open said radial aperture 19 either fully or partially by acting upon said valve assembly 2.

Connection device 4 according to the present invention comprises a single coupling device 6 for connecting said opening device 7 to said valve assembly 2.

Said opening device 7 is adapted to selectively open and close, at least partially, said radial aperture 19 by acting upon a first obstructor 22 comprised in valve assembly 2 through at least one at least rotary movement. The opening and closing of said radial aperture 19, effected by acting upon said valve assembly by moving said first obstructor 22, is useful for safely controlling the circulation of fluids "P" in the drilling rig.

In said connection device 4, according to the present invention, coupling device 6 is adapted to engage with a clamping element 23 comprised in the same first obstructor 22, so that said at least one at least rotary movement of said opening device 7 is transferred to said first obstructor 22 in order to selectively open and close, at least partially, said radial aperture 19. In particular, said at least one at least rotary movement of said opening device 7 acting upon said first obstructor 22 brings about the selective, an at least partial, opening and closing of valve assembly 2 and hence of radial aperture 19.

Unlike a purely linear movement, the execution of at least one at least rotary movement makes for higher certainty that the radial aperture will be opened and closed correctly.

For the purposes of the present invention, the phrase "opening device 7 is adapted to selectively open and close, at least partially, said radial aperture 19 by acting upon a first obstructor 22" means that, by acting upon said first obstructor 22, it can open a first valve or barrier, which may be essential but not sufficient to completely open said radial aperture 19. In fact, in the exemplary but non-limiting embodiments illustrated and described herein there is a second obstructor 24, e.g. consisting of a non-return valve, which, as is known to a man skilled in the art, will take the second operating configuration, when opening the valve associated therewith, only if between the two walls of the second obstructor 24 there is a pressure difference that will allow it to open, thus causing the definitive opening of radial aperture 19.

In particular, said connection device 4 is adapted to open a first valve, comprising said first obstructor 22, comprised in valve assembly 2.

The movement of opening device 7 allows said first obstructor 22 to switch between the two different operating configurations corresponding to the at least partial closing and opening of said valve assembly 2, and hence of radial aperture 19.

Said connection device 4, according to the present invention, may be comprised in a secondary circuit 12 for circulating fluid "P", which in turn may be comprised in a drilling rig.

Connection device 4 according to the present invention envisages that, following the connection to said drilling element 17, intake duct 41 will face radial aperture 19, in particular in axis with the same radial aperture 19. This feature allows said connection device to remain compact and take less room, while increasing the work area accessible on the drill floor. Furthermore, thanks to the compactness of device 4, the whole equipment is generally easier to handle.

Figure 2B:
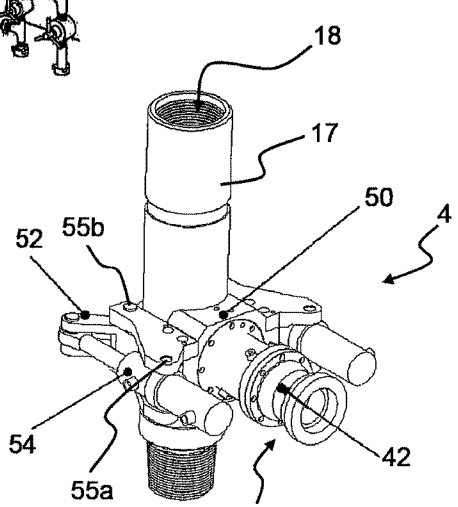
FIGS. 2A and 2B show the connection device according to the present invention; in particular.
Figure 2A:
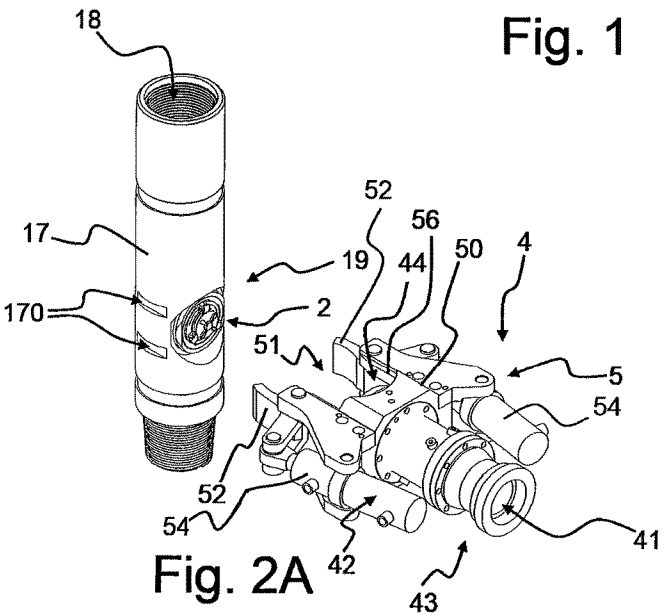

FIGS. 2A and 2B show, by way of non-limiting example, a generic connection device 4 according to the present invention.

In particular, FIGS. 2A and 2B show a system comprising a connection device 4 according to the present invention, and a drilling element 17 comprising a radial aperture 19 with which a valve assembly 2 is associated.

FIG. 2A shows the generic connection device 4 disconnected from drilling element 17, whereas FIG. 2B shows connection device 4 and drilling element 17 connected to each other. FIG. 2A shows a connection device wherein clamping system 5 is in an open or released configuration; whereas FIG. 2B shows a connection device wherein clamping system 5 is in a closed or holding configuration. In this latter configuration, connection element 4 is sealingly connected to said drilling element 17, thereby allowing circulation of drilling fluids "P", such as mud, through radial aperture 19, once said valve assembly 2 has been opened.

More in detail, clamping system 5 comprises: a housing portion 51 for housing, at least partially, a drilling element 17; and at least one arm 52 for encircling said drilling element 17, keeping it abutted in said housing portion 51 and preventing it from moving, e.g. from rotating and/or moving along the axis of the same drilling element 17. Clamping system 5 further comprises at least one tightening actuator 54 for moving said at least one arm 52 in order to exert a force on said drilling element 17 and keep it in abutment. Said at least tightening actuator 54 allows the clamping system to switch between the open configuration and the closed configuration.

In general, clamping system 5 according to the present invention can be adjusted in a simple and quick manner as a function of drilling element 17 being used in the drilling rig, ensuring proper sealing because of the pressure exerted on the same drilling element 17.

Preferably, said tightening actuator 54 is rotatably constrained to said arm 52. In particular, said tightening actuator 54 is constrained to one end of said arm 52. This technical solution ensures, in a simple manner, that connection device 4 will be firmly secured to drilling element 17. The present solution also contributes to automating the connection to drilling element 17.

In one exemplary embodiment, clamping system 5 comprises two arms 52, with each one of which a tightening actuator 54 is associated, as shown by way of example in FIGS. 2A and 2B.

In the different embodiments of connection device 4 illustrated by way of non-limiting example in the present description, two arms 52 are comprised, with each one of which one tightening actuator 54 is associated. This solution is particularly advantageous for automating the connection to drilling element 17.

In general, said clamping system 5 comprises at least one support structure 50 constrained to said central body 42, in particular arranged in proximity to said second connection portion 44, as shown by way of example in FIG. 2A. Said support structure 50 and said second portion 44 may be made either as one piece or as multiple pieces assembled together. Both said at least one tightening actuator 54 and said at least one arm 52 are rotatably secured to said at least one support structure 50. In particular, said at least one tightening actuator 54 is secured to support structure 50 at a first pivot point 55*a*, and one end thereof is fastened to one end of at least one arm 52.

Preferably, each arm 52 is rotatably constrained to support structure 50 at a second pivot point 55*b*. The free end of each arm 52 is adapted to abut against drilling element 17 in order to bring it in abutment in housing portion 51. Said second pivot point 55*b* of each arm 52 is located at an intermediate point between the ends of the same arm 52, preferably proximal to the free end of arm 52 itself, in order to provide an advantageous lever.

As shown in FIGS. 2A and 2B, said tightening actuator 54 is a linear actuator, preferably an oil-pressure one. Said first pivot point 55*a* allows tightening actuator 54 to rotate while extending and retracting, thereby causing the rotary movement of arm 52 about the second pivot point 55*b*, as clearly shown in the annexed drawings. In order to optimize the movement of arm 52 as a function of the action of tightening actuator 54, the same arm 52 has an "L" shape.

In the embodiment shown in the drawings, which comprises two arms 52 and the associated tightening actuators 54, the shape of said support structure 50 is symmetrical with respect to a first central axis "X".

Figure 3B:
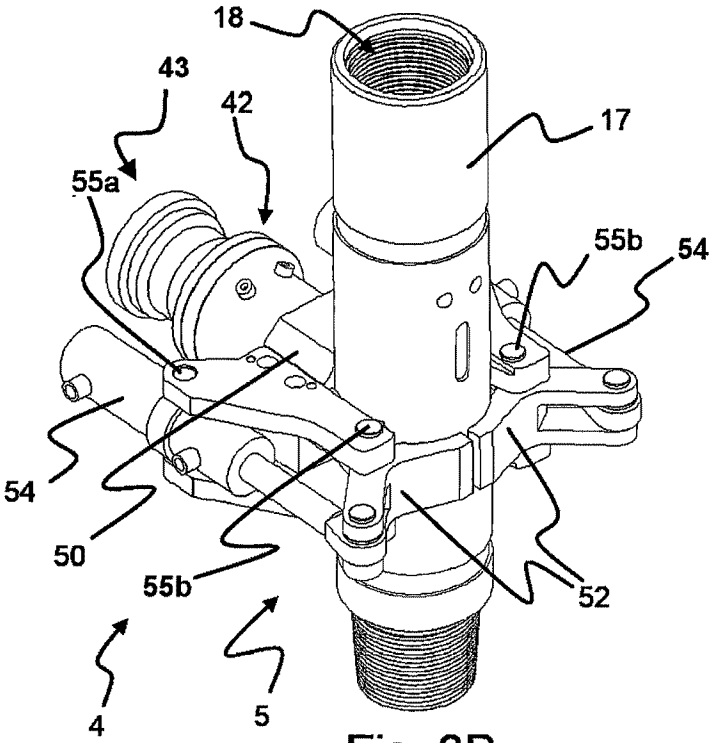
FIGS. 3A and 3B show the connection device in a first embodiment; in particular.
Figure 3A:
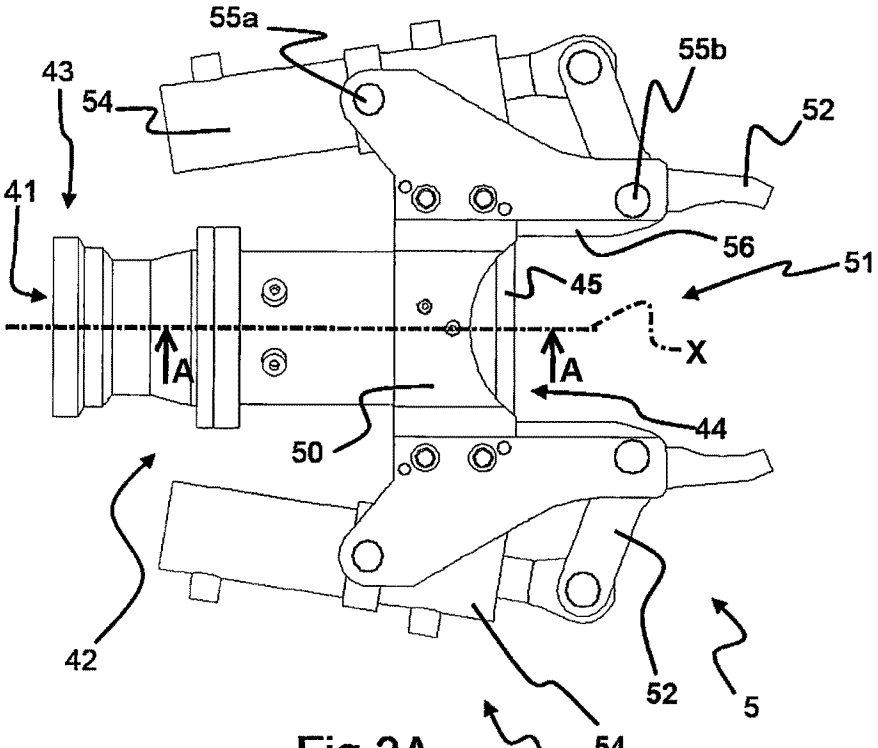
Figure 6B:
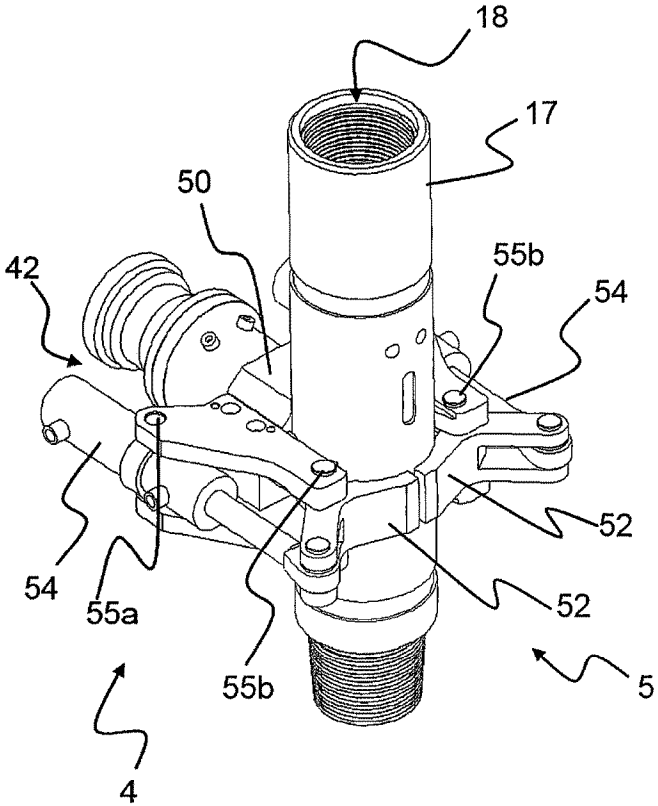
FIGS. 6A and 6B show the connection device in a second embodiment; in particular.
Figure 6A:
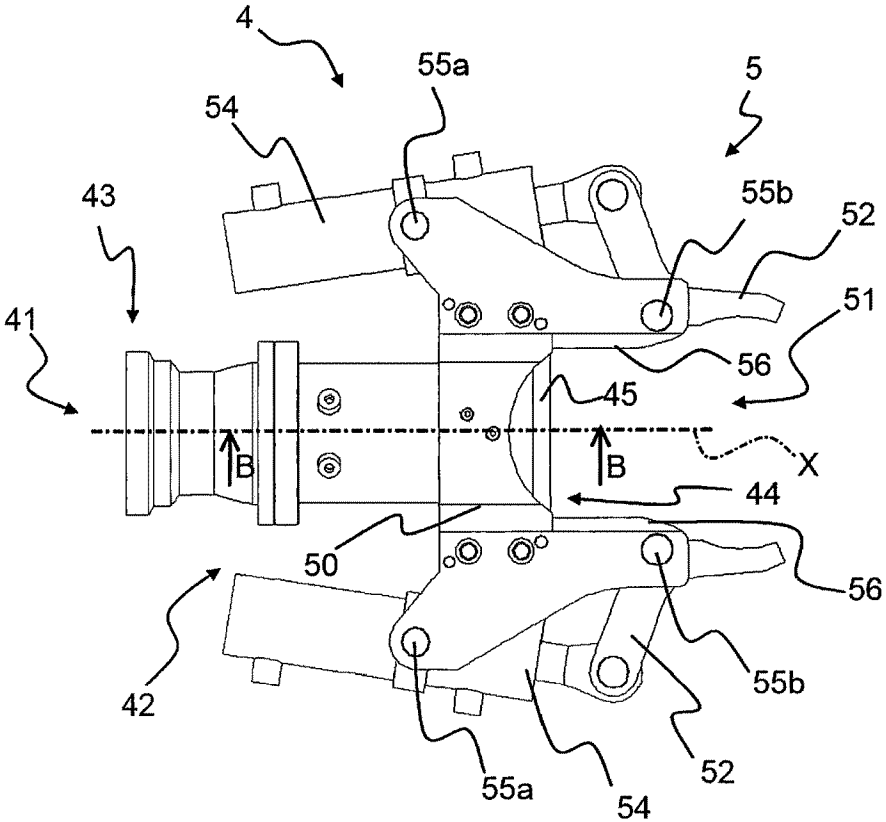
Figure 9B:
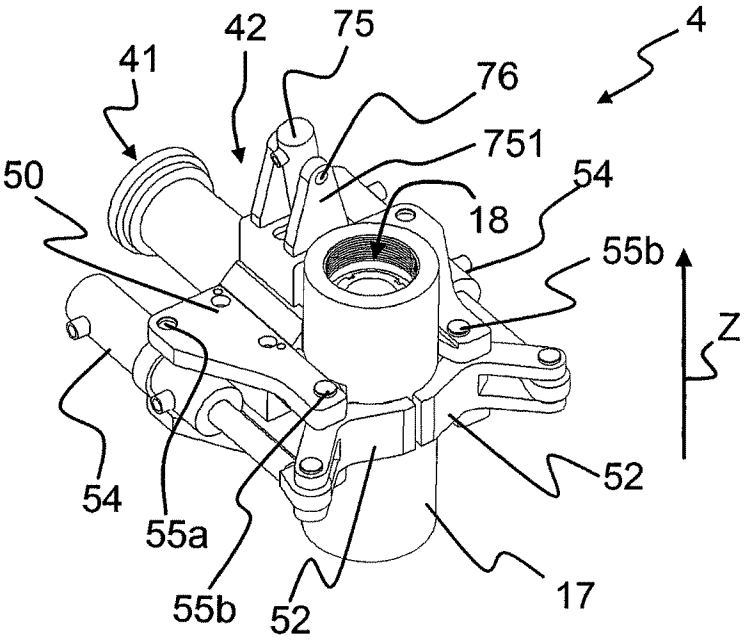
FIGS. 9A and 9B show the connection device in a third embodiment; in particular.
Figure 9A:
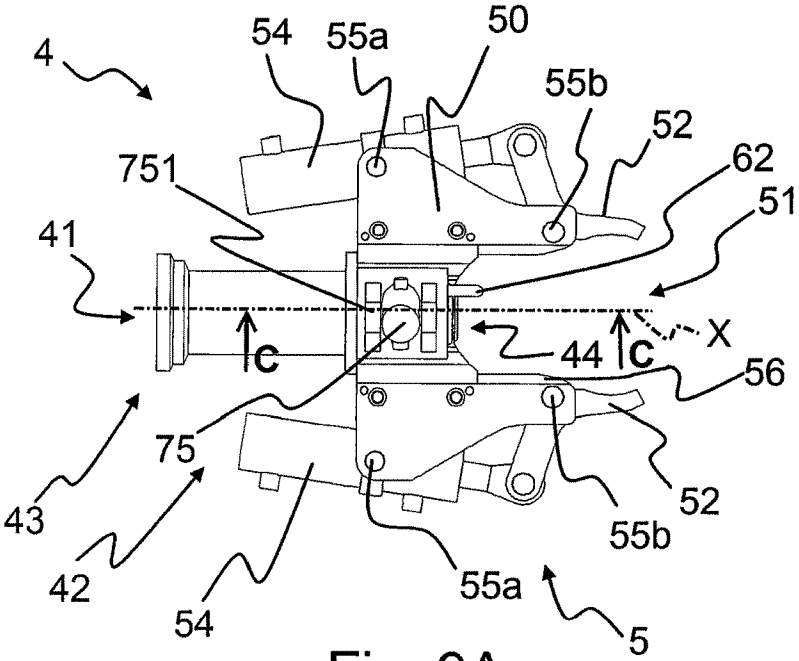
Figure 10B:
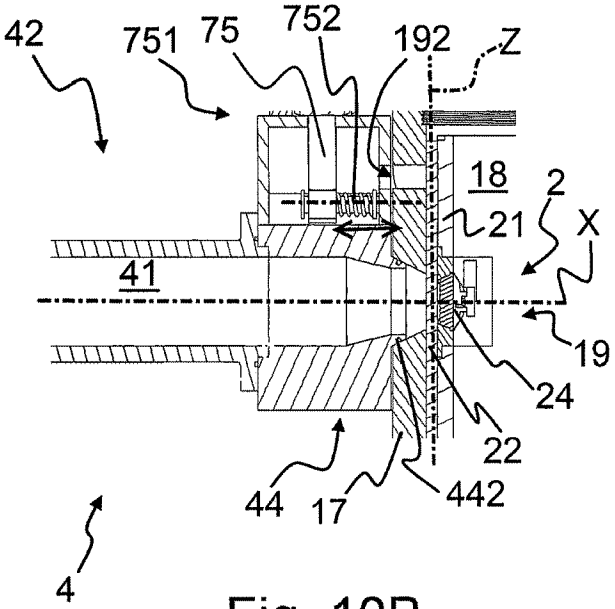
FIGS. 10A and 10B show different views of the actuating device; in particular.
Figure 10A:
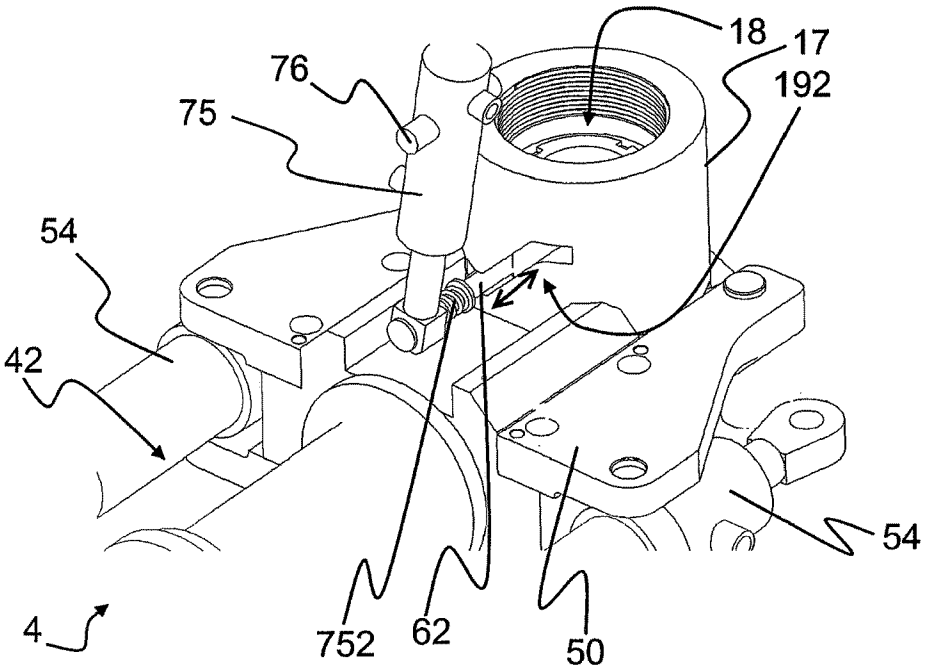
Figure 11A:
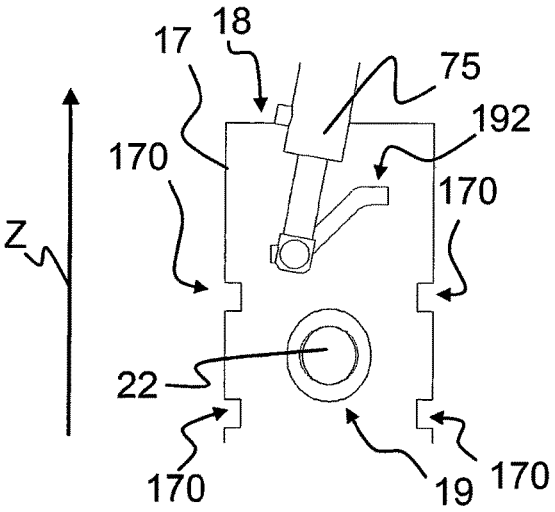
FIGS. 11A and 11B show the actuating device in an initial operating stage prior to a first movement of the first obstructor; in particular.
Figure 11B:
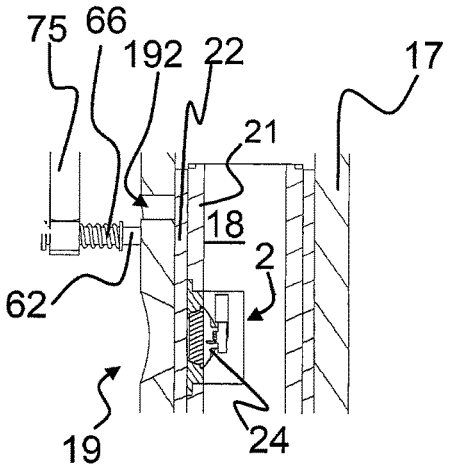
Figure 12A:
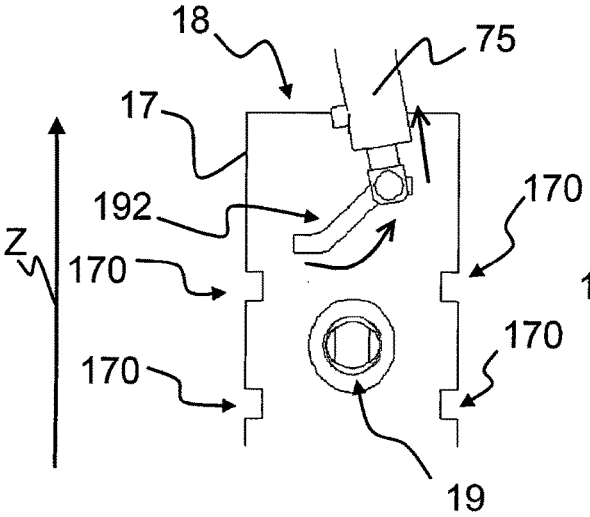
FIGS. 12A and 12B show the actuating device at a final operating stage following a first movement of the first obstructor; in particular.
Figure 12B:
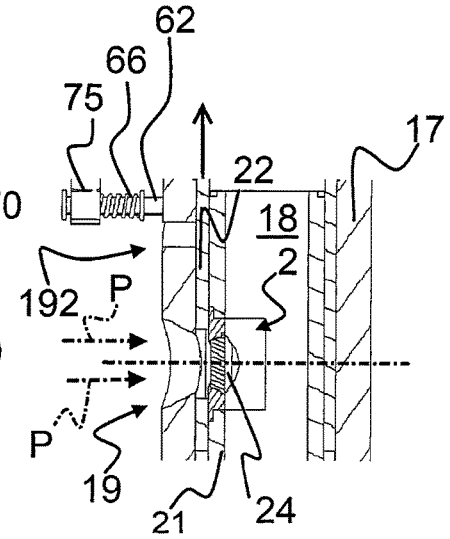
Figure 13:
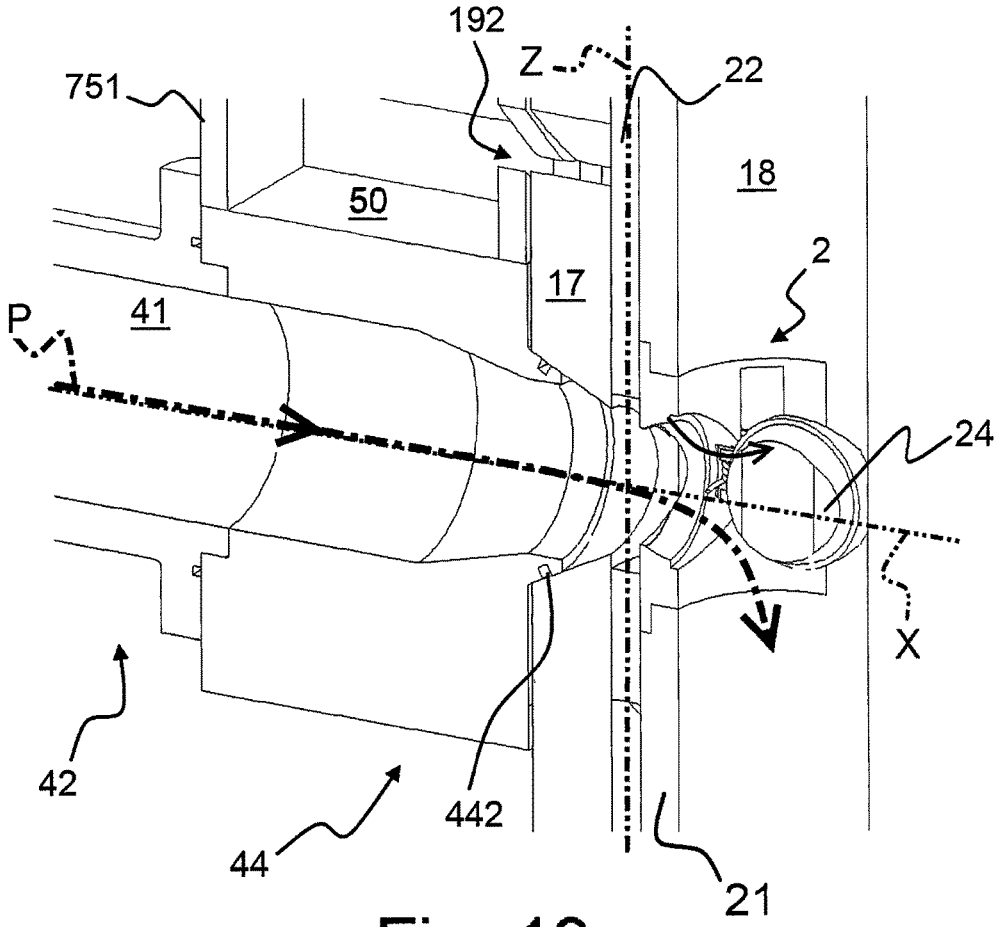
FIG. 13 shows a perspective sectional view in plane C-C of the connection device according to the third embodiment, wherein also the second obstructor of the valve assembly is moved by the pressure of the drilling fluid flowing through the radial aperture.

Preferably, as shown in FIGS. 3A, 6A and 9A, the structure of connection device 4 is symmetrical with respect to said first axis "X", which is longitudinal with respect to intake duct 41.

Said housing portion 51 preferably has a semicircular shape suitable for housing drilling element 17, at least partially, between its jaws. The shape of said housing portion 51 is preferably defined by support structure 50 itself, as shown by way of example in FIGS. 2A, 3A, 6A and 9A. In particular, said second connection portion 44 abuts in said housing portion 51. The same second portion 44 will abut on radial aperture 19 to be associated therewith and ensure pressure tightness during the connection between the same connection device 4 and drilling element 17. FIGS. 3A, 6A and 9A show one example of a relative arrangement between housing portion 51 and the second connection portion 44.

In general, each second pivot point 55*b* of at least one arm 52 is advantageously located on said support structure 50 in proximity to one end of a jaw of housing portion 51, in particular at one end of the semicircular structure of the same portion 51.

Clamping system 5 optionally comprises at least one protuberance 56 located on said support structure 50, within housing portion 51. Preferably, said at least one protuberance 56 extends, at least partially, along at least one jaw of housing portion 51. Said protuberance 56 is adapted to be inserted into guides 170 comprised in drilling element 17, as shown by way of example in FIG. 2A. Preferably, said protuberances 56 are located on both of the jaws that define housing portion 51. As many guides 170 as said protuberances 56 are comprised on drilling element 17.

Such protuberances 56 and such guides 170 facilitate the alignment of connection device 4, in particular of the second connection portion 44, with radial aperture 19 comprised in drilling element 17 to which it must be connected. Moreover, the coupling between protuberances 56 and guides 170 prevents any relative movement between drilling element 17 and connection device 4 according to the present invention.

In one embodiment of clamping system 5, said support structure 50 is made as one piece, univocally defining housing portion 51. In an equivalent embodiment, said support portion 50 is made by assembling together at least three components, i.e. a main central portion and two side portions defining the jaws of housing portion 51. In this latter embodiment, said two side portions comprised in support portion 50, whereon said at least one arm 52 and said at least one tightening actuator 54 are secured, are interchangeable, so that the size and shape of housing portion 51 can be changed.

In general, said coupling device 6 comprises a fitting element 62 adapted to be coupled to a corresponding clamping element 23 comprised on said first obstructor 22. Coupling device 6 further comprises a coupling actuator 64 for moving said fitting element 62.

In general, said opening device 7 comprises at least one first opening actuator 72 adapted to cause said coupling device 6, in particular at least said fitting element 62, to make at least one rotary movement.

In a first embodiment, coupling device 6 and opening device 7 are arranged inside central body 42, e.g. within intake duct 41, and are secured through support elements 412, e.g. to the inner walls of the same intake duct 41.

In a first embodiment, coupling device 6 and opening device 7 are arranged outside central body 42, e.g. secured to central body 42 itself or to support structure 50 by means of fastening structures 751.

Hybrid embodiments, wherein either one of coupling device 6 and opening device 7 is internal to duct 41, while the other is external to central body 42, will still fall within the protection scope of the present invention.

In general, connection device 4 comprises a control system 8 for automatically controlling device 4 according to the present invention. Said control system 8 is adapted to control and activate the devices (5, 6, 7), in particular the actuators (54, 64, 72, 73, 75) comprised in a connection device 4, as shown by way of example in FIG. 14.

Said control system 8 comprises a plurality of sensors 82, not shown in detail herein, for detecting a plurality of physical quantities, such as, for example, distance, pressure, relative movements, rotations, relating to, for example, at least one device (5, 6, 7) comprised in connection device 4. The same control system 8 comprises at least one data processing unit 84 for processing the data obtained from said plurality of sensors 82, for the purpose of automatically controlling and activating the devices (5, 6, 7) comprised in connection device 4.

Figure 14:
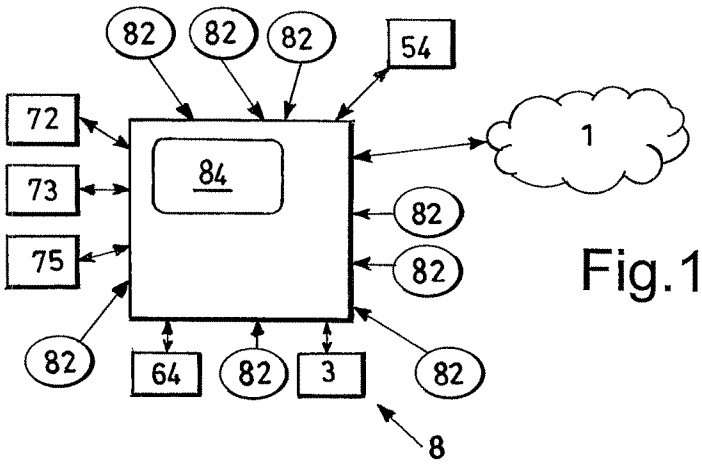
FIG. 14 shows a block diagram of the control system for controlling the connection device according to the present invention.

Said control system 8 may be adapted to control and handle only connection device 4 according to the present invention, or it may be a part of a control circuit capable of controlling the entire drilling rig, e.g. so that all operations that are now carried out manually or semiautomatically can be controlled in a fully automated manner by the operator in the doghouse. FIG. 14 schematically illustrates the interaction between control system 8 and connection device 4 and the rest of the drilling rig, designated by reference numeral 1 in the drawing.

Figure 15B:
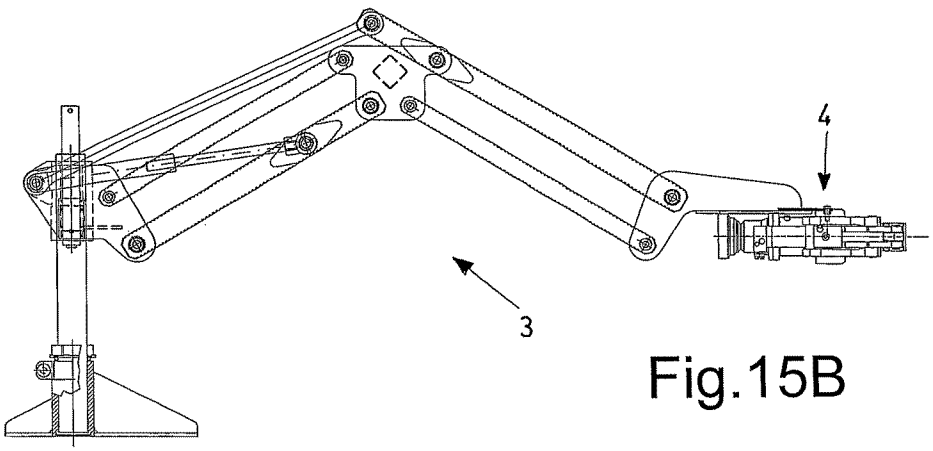
FIGS. 15A and 15B show one possible embodiment of the moving system for the connection device according to the present invention; in particular.
Figure 15A:
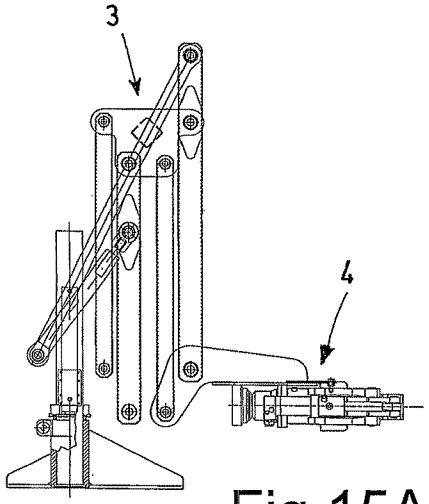

In general, at least one handling system 3 is associated with said connection device 4, which system can handle said connection device 4. In particular, said handling system 3 is adapted to bring said connection device 4 near or away from said drilling element 17. The handling of connection device 4 for connecting and releasing it to/from said drilling element 17 contributes to the automation of the drilling rig. FIGS. 15A and 15B illustrate by way of non-limiting example said handling system 3; in particular, FIG. 15A shows handling system 3 in a compact or retracted configuration. Instead, FIG. 15B shows the same handling system in an extended configuration. Even though they may have not been described in detail herein, all the components shown in FIGS. 15A and 15B are to be understood as comprised in the present invention, since they are easily identifiable by a man skilled in the art. Other equivalent embodiments of handling device 3 for handling connection device 4 will have to be considered as included in the present patent description.

Also as regards the remaining drawings annexed hereto, all components shown therein, even though they may not have been described in detail herein for brevity's sake, will have to be considered as included in the present description, since their function will be apparent to a man skilled in the art.

As aforementioned, said valve assembly 2, associated with a drilling element 17, and connection device 4, connected to a secondary circuit 12 for the circulation of fluids "P", constitute a system or assembly wherein they cooperate together. Said valve assembly 2, which is adapted to selectively open and close a radial aperture 19 on drilling element 17, comprises a valve body 21 that houses at least two obstructors (22, 24) arranged in cascade along the direction of the path followed by fluids "P". In particular, a first obstructor 22 forming a first barrier outside radial aperture 19, and a second obstructor 24 forming a second barrier.

Other embodiments of valve assembly 2 may be associated with the radial aperture; the connection device according to the present invention will still be able to open any valve or valve assembly that requires at least one rotary movement of the first obstructor 22, which is the outermost one relative to axial hole 18 of drilling element 17.

Connection device 4 according to the present invention is adapted to be comprised in a drilling rig, in turn comprising a fluid circulation circuit, a collector circuit 10, a main circuit 11, and a secondary circuit 12, as shown by way of example in FIG. 1 and as known to those skilled in the art.

The following will describe some different exemplary embodiments of connection device 4. In particular, connection devices 4 will be described which are adapted to act upon three different types of first obstructors 22 of valve assembly 2 associated with radial aperture 19 of drilling element 17, all of which share one common inventive concept, i.e. opening said radial aperture 19, at least partially, by acting upon at least one obstructor of valve assembly 2 instead of removing a plug, thus improving safety.

FIGS. 3A-5 illustrate a first embodiment of connection device 4. In this embodiment, opening device 7 is adapted to selectively open and close, at least partially, said radial aperture 19 by acting upon said first obstructor 22 of valve assembly 2. In particular, said opening device 7 only makes one rotary movement, which is transmitted to said first obstructor 22. In particular, said rotary movement is a movement about said first axis "X", more in particular comprised between 10° and 180°, preferably 90°.

Said coupling device 6 and said opening device 7 are arranged inside central body 42. In particular, coupling device 6 and opening device 7, and also, more in particular, their respective actuators (64, 72), are located inside intake duct 41, as shown by way of example in FIGS. 4A-5. Coupling device 6 and the respective opening device 7, and in particular the respective actuators (64, 72), are secured to the inner wall that define intake duct 41. Preferably, actuators (64, 72) are enclosed in a common outer casing 60, in particular within a suitable internal housing. Said outer casing 60 is secured, through a support element 412, to the walls of intake duct 41.

Within intake duct 41 there are both coupling device 6, and in particular fitting element 62 and coupling actuator 64, and opening device 7, and in particular opening actuator 72.

Said opening actuator 72 is adapted to move fitting element 62 for opening and closing, at least partially, radial aperture 19 by acting upon the first obstructor 22. Said first obstructor 22 is the external obstructor of valve assembly 2, with reference to axial hole 18 of drilling element 17.

The following will briefly describe the operating sequence for connecting and then disconnecting connection device 4 to/from drilling element 17.

At the end of the drilling step, i.e. when every drilling element 17, preferably one length, has been inserted into drilling well "h", connection device 4 is brought near and connected to the last drilling element, which is still partially out of drilling well "h". The step of bringing connection device 4 near is carried out by moving said connection device 3, in particular by having it switch from a retracted configuration to an extended configuration. This approaching step is carried out while keeping the operating conditions of the fluid circulation system unchanged, i.e. by letting drilling fluid "P" circulate through main circuit 11 as during the drilling step.

Connection device 4, once it has come near drilling element 17, clamps drilling element 17 by means of clamping system 5, as shown by way of example in FIG. 3B.

The two tightening actuators 54 allow clamping system 5 to switch from the open configuration to the closed configuration. Said tightening actuators 54 also perform the function of keeping the connection energized, by means of a gasket 442 that, being positioned at the aperture of the second connection portion 44, will abut on valve body 21 of valve assembly 2, thus ensuring proper hydraulic sealing, as shown by way of example in FIG. 4A. Said gasket 442 may possibly abut on the outer walls that define radial aperture 19.

Furthermore, in the embodiment shown in FIGS. 3A-5 said connection portion 44 comprises a retaining flange 45 to be inserted into a retaining flange housing 171.

After clamping system 5 has clamped drilling element 17, coupling device 6 is coupled to valve assembly 2, the latter switching from a non-operating configuration to an operating configuration. In particular, as shown by way of example in FIG. 4B, coupling actuator 64 moves fitting element 62 in order to cause it to abut against clamping element 23 of the first obstructor 22.

Figure 4A:
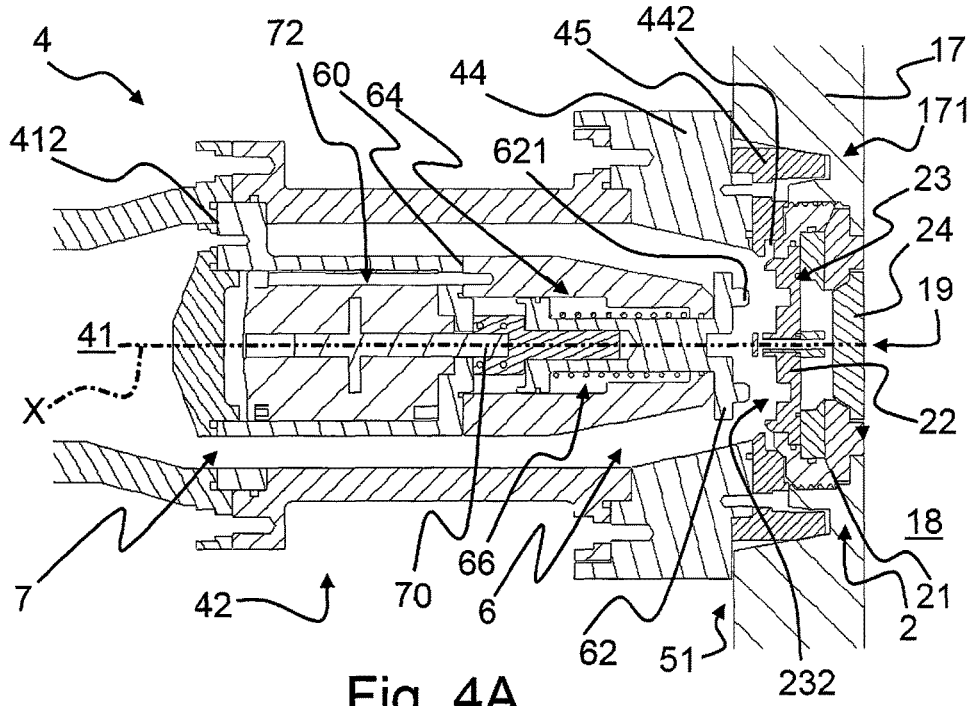
FIGS. 4A, 4B and 4C show an A-A section of the connection device of FIG. 3A, in different operating configurations of the devices comprised in the connection device of the first embodiment; in particular.
Figure 4B:
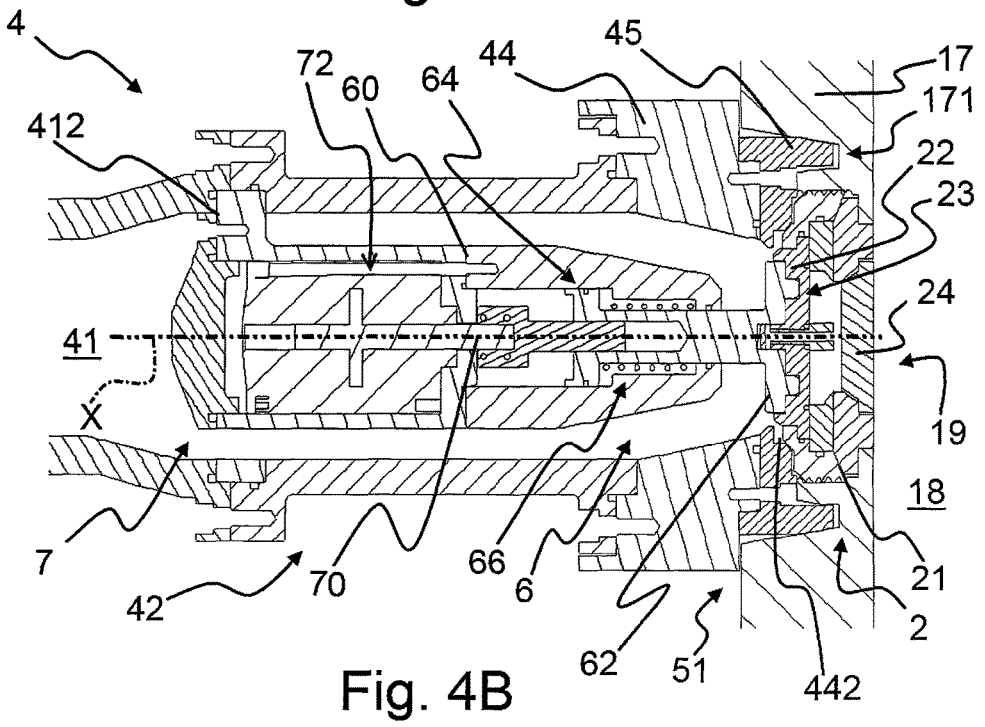

In the present embodiment, as shown by way of example in FIG. 4A, fitting element 62 has a discoidal shape comprising protrusions 621 to be inserted into suitable seats 232, the shape of which is complementary to said protrusions 621, obtained in clamping element 23. Said coupling actuator 64 is a linear actuator, preferably a pneumatic one. Said fitting element 62 is kept in contact with the first obstructor 22 through an elastic means 66 such as a coil spring, for the purpose of avoiding any undesired disconnection between the two parts (62, 23).

After the fitting element 62 has been attached to clamping element 23, opening device 7 is activated, thus switching from a non-operating configuration to an operating configuration. In particular, opening actuator 72, e.g. a pneumatic actuator, is turned on. Said opening actuator 72 is adapted to perform a rotary movement.

Figure 4C:
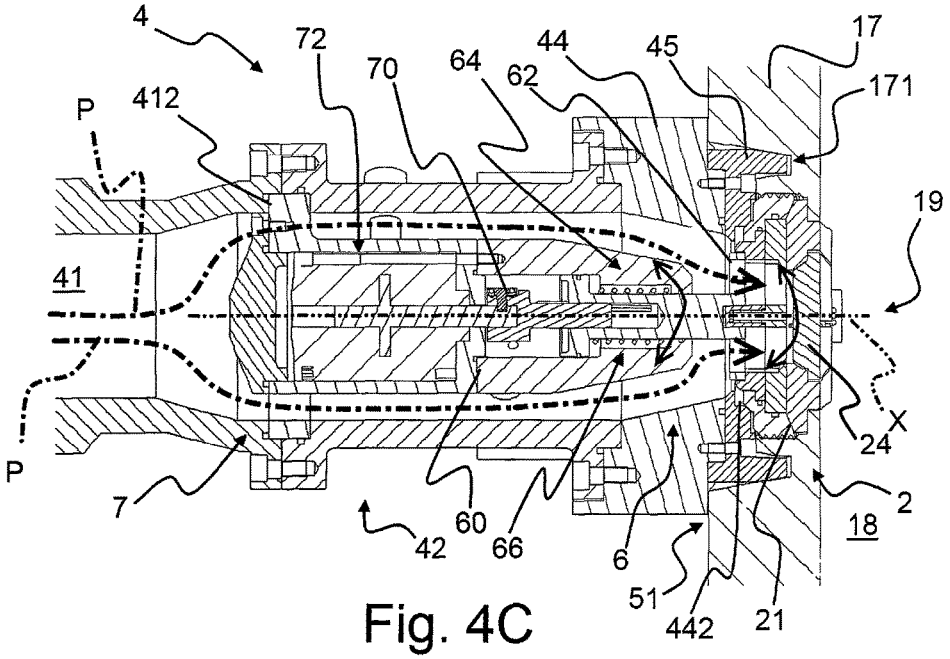
Figure 5:
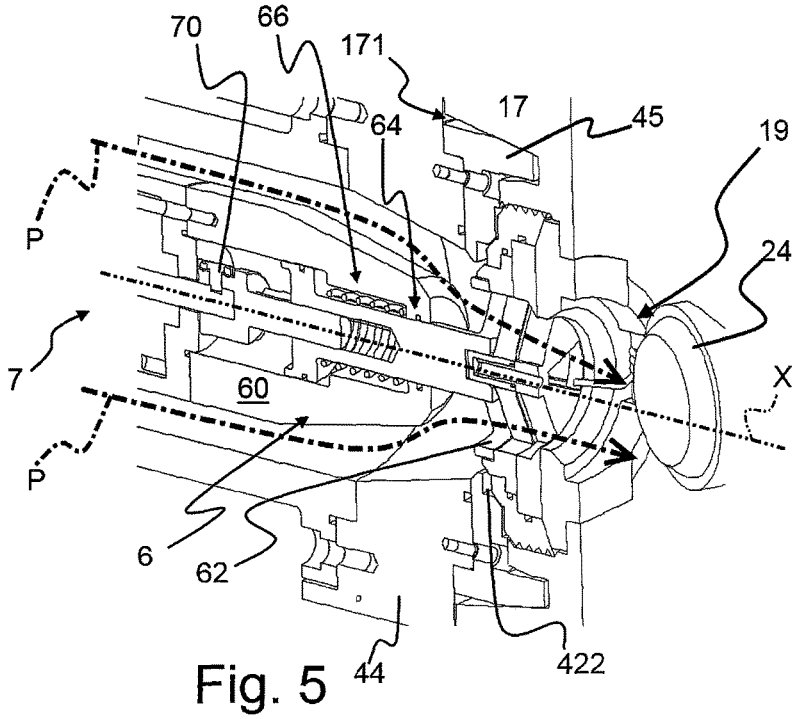
FIG. 5 shows a perspective sectional view in plane A-A of the connection device according to the first embodiment, wherein also the second obstructor of the valve assembly is moved by the pressure of the drilling fluid flowing through the radial aperture.

Opening actuator 72, while making a rotary movement, rotates fitting element 62, which in turn rotates the first obstructor 22 about the axis "X", as shown by way of example in FIG. 4C. The rotation of the first obstructor 22 of valve assembly 2 brings it into the second operating configuration, thereby causing the opening of a first valve with which the same first obstructor 22 is associated, thus partially opening said radial aperture 19. In particular, four passages are opened, preferably equally spaced, e.g. by 90°, through which drilling fluid "P" will be able to flow during its circulation in the secondary circuit 12.

The operation and the technical features of valve assembly 2 illustrated in this embodiment are described in detail in Italian patent application ITTO=20130722 filed by the present Applicant.

In order to transmit the motion from opening device 7 to coupling device 6, there is a joint 70 for connecting the rotary portion, or rotor, of opening actuator 72 to the piston of coupling actuator 64, as clearly shown in FIG. 4C.

After the first valve associated with the first obstructor 22 has been opened, drilling fluid "P", diverted into secondary circuit 12 through collector circuit 10, can flow past the first valve because the first obstructor 22 has switched into the second operating configuration, thus removing the first barrier to the circulation of fluids through radial aperture 19. The last barrier that needs to be removed in order to definitively establish the circulation of drilling fluid "P" through radial aperture 19 consists of a second obstructor 24, e.g. a non-return valve, as shown by way of example in FIG. 4C. The pressure difference between the inside of intake duct 41, caused by drilling fluid "P", and the inside of axial hole 18 of drilling element 17 allows said second obstructor 24 to move in order to open a second valve of valve assembly 2. The movement of the second obstructor 24 causes said second valve to open, thereby allowing circulation of fluid "P" through radial aperture 19, as shown by way of example in FIG. 5, since the second obstructor 24 gets into the second operating configuration, thus removing the last barrier. In this configuration, both obstructors (22, 24) are in the second operating configuration, which causes the two valves respectively associated therewith to open.

Once the step of feeding the drilling fluid through radial aperture 19 is complete, i.e. when a flow of fluid "P" can be re-established through main circuit 11 towards axial hole 18 of drilling element 17, opening actuator 72 is activated again. Following its activation, opening actuator 72 makes a rotation, preferably contrary to the direction of rotation taken for opening the first valve with which the first obstructor 22 is associated, for the purpose of closing the same first valve. The closing of the first valve causes said first obstructor 22 to be set back into the first operating configuration, thus becoming again a barrier preventing the circulation of flow "P" through radial aperture 19. In this situation, the devices (6, 7) comprised in connection device 4 have come to an operating configuration substantially equivalent to the one shown in FIG. 4B. The closing of the first valve causes the simultaneous closing of the second valve as well, which brings the second obstructor 24 back into the first operating configuration to form a second barrier.

Once the barrier consisting of the first obstructor 22 has been closed, coupling actuator 64 can be activated in order to retract fitting element 62 of clamping element 23 back into the initial non-operating configuration, e.g. as shown in FIG. 4A. Clamping system 5, and in particular tightening actuators 54, are then activated in order to achieve an open operating configuration for releasing drilling element 17.

Subsequently, through said handling system 3, opening device 4 is moved away from drilling element 17.

In the present embodiment, said clamping system 5, said coupling device 6 and said opening device 7 are activated and controlled by control unit 8 via said plurality of sensors 82, for the purpose of executing the above-described operating sequence.

FIGS. 6A-8 illustrate a second embodiment of connection device 4 according to the present invention. In the present embodiment, opening device 7 is adapted to selectively open and close, at least partially, said radial aperture 19 by acting upon said first obstructor 22 of valve assembly 2 by making a rototranslational movement. In order to obtain this rototranslational movement, two distinct actuators are comprised, one for the rotary movement and one for the translational movement. In particular, said opening device 7 comprises a first opening actuator 72 for the rotary movement about said first axis "X", in particular comprised between 10° and 120°, e.g. 90°, and at least one second opening actuator 73 adapted to cause said fitting element 62 to make a translational movement for a finite length.

Figure 7A:
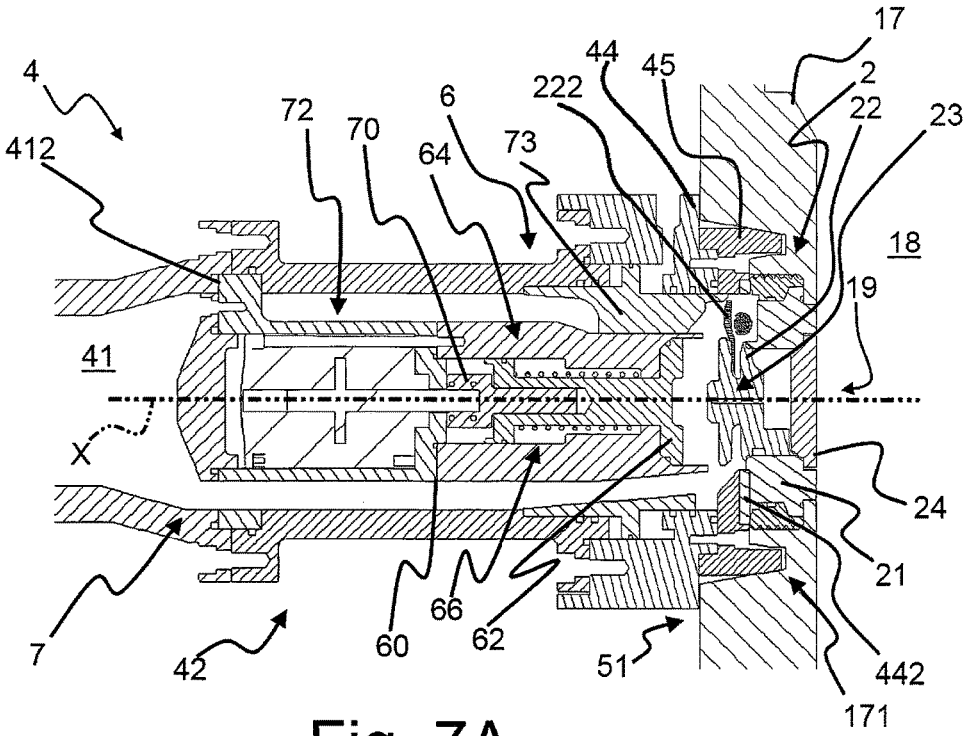
FIGS. 7A, 7B, 7C and 7D show a B-B section of the connection device of FIG. 6A, in different operating configurations of the devices comprised in the connection device of the first embodiment; in particular.
Figure 7B:
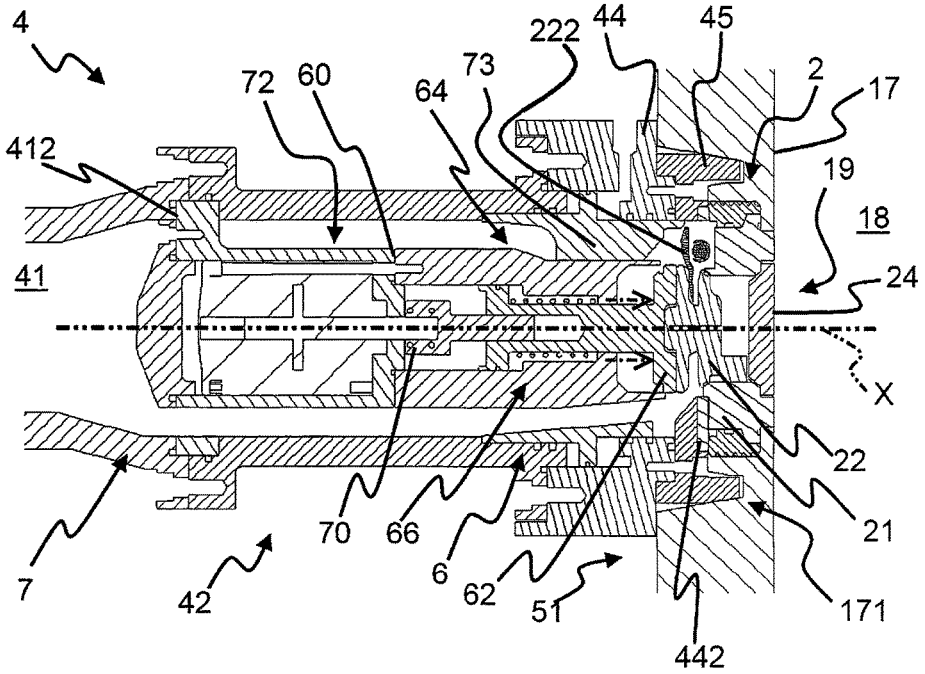
Figure 7C:
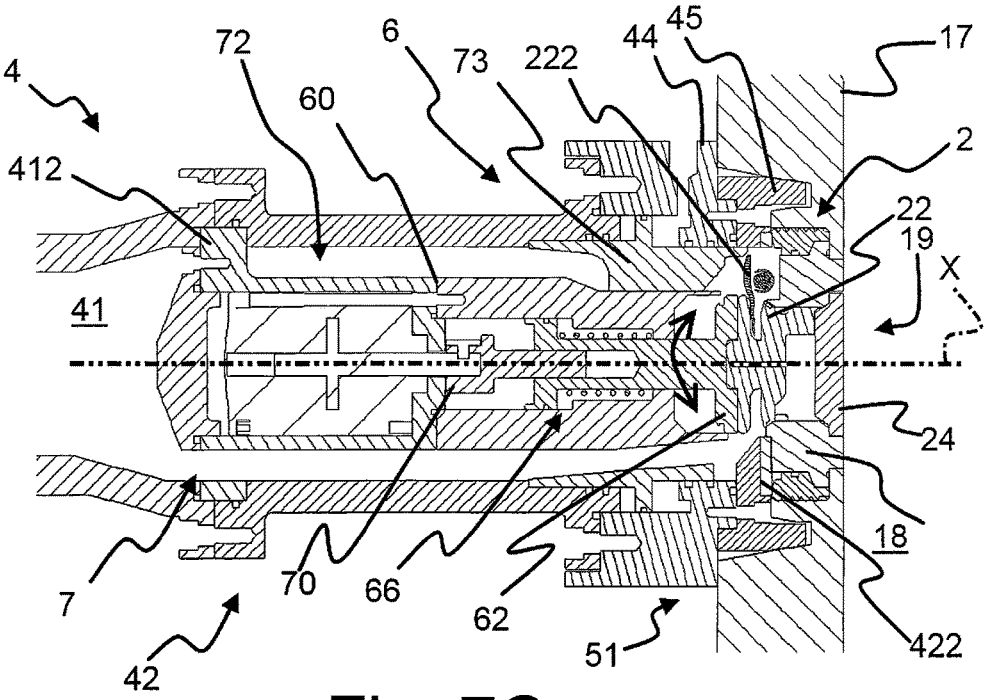
Figure 7D:
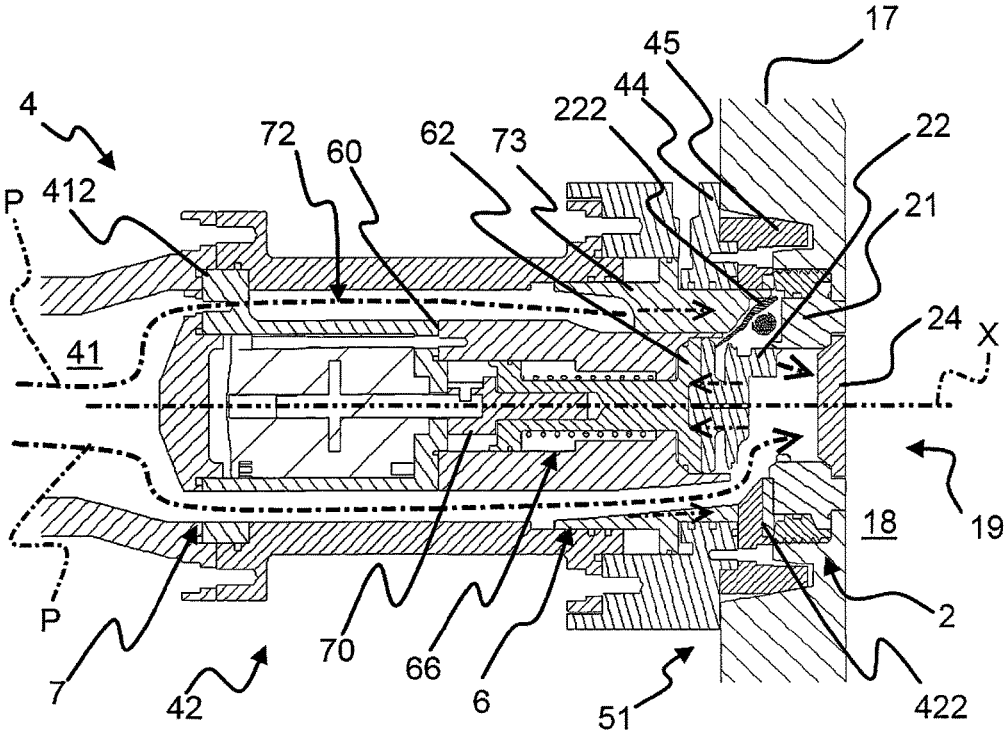
Figure 8:
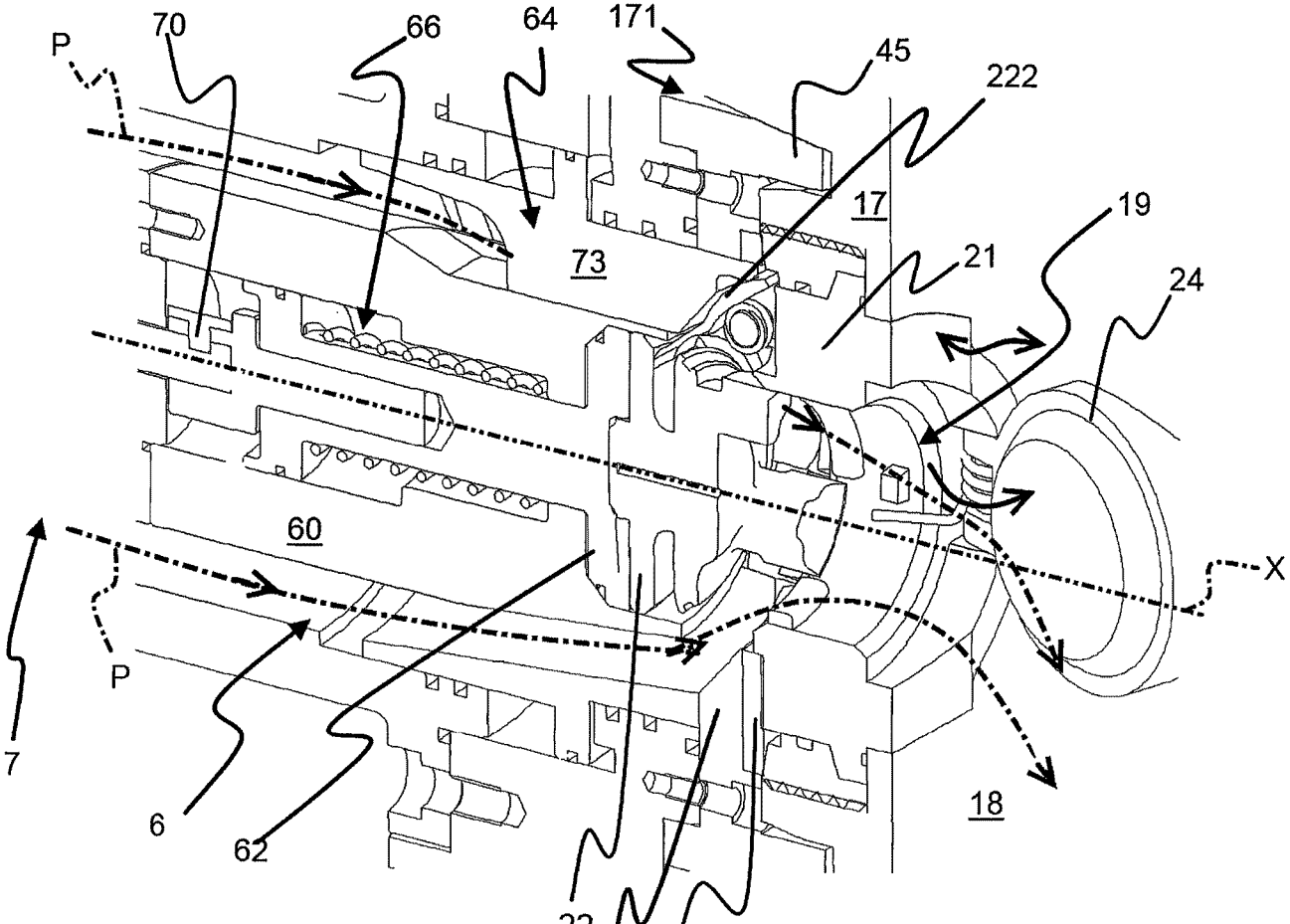
FIG. 8 shows a perspective sectional view in plane B-B of the connection device according to the second embodiment, wherein also the second obstructor of the valve assembly is moved by the pressure of the drilling fluid flowing through the radial aperture.

As in the previously described embodiment, in the present embodiment said coupling device 6 and said opening device 7 are arranged inside central body 42, in particular within intake duct 41, as shown by way of example in FIGS. 7A-8. Preferably, the actuators (64, 72) are enclosed in common outer casing 60, which is secured to the walls of intake duct 41 through a support element 412. Those parts which are common to the previous embodiment will not be described again because they will be apparent to a man skilled in the art.

The following will briefly describe the operating sequence for connecting and then disconnecting connection device 4 to/from drilling element 17. Those parts which are common to the previous embodiment will not be described in detail.

The step of bringing connection device 4 near the drilling element is effected by moving said connection device 3. Connection device 4, once it has arrived in the proximity of drilling element 17, clamps drilling element 17 by means of clamping system 5 and keeps the connection energized by pressing a gasket 442, as in the previous embodiment, thereby ensuring proper hydraulic sealing, as shown by way of example in FIG. 7A. Also this embodiment uses a retaining flange 45 to be inserted into a retaining flange housing 171.

After clamping system 5 has clamped drilling element 17, coupling device 6 is coupled to valve assembly 2, switching from a non-operating configuration to an operating configuration, as shown by way of example in FIG. 7B.

In the present embodiment, fitting element 62 has a discoidal shape comprising seats adapted to house complementarily shaped protrusions extending from clamping element 23. Said coupling actuator 64 is a linear actuator, preferably a pneumatic one. As in the previous case, said fitting element 62 is kept in contact with the first obstructor 22 by an elastic means 66.

After fitting element 62 has been attached to clamping element 23, opening device 7, in particular opening actuator 72, is activated to switch from a non-operating configuration to an operating configuration and cause the first obstructor 22 to make a rotary movement as in the previous embodiment, e.g. as shown in FIG. 7C.

In order to transmit the motion from the opening actuator 72 to coupling device 6, a joint 70 is used as in the previous embodiment and as shown in FIG. 7C.

In order to counter the force exerted by elastic means 66 and allow the first obstructor 22 to move, resulting in the definitive opening of the valve with which the obstructor is associated, the second opening actuator 73 is activated. Said second opening actuator 73, while switching from a non-operating configuration to an operating configuration, acts upon at least one cam 222; in particular, it presses on a plurality of cams 222, as shown by way of example in FIG. 7D.

Said pressure exerted by the second opening actuator 73 on said plurality of cams 222 causes the first obstructor 22 to translate along axis "X"; as a consequence, fitting element 62 associated therewith will bring said obstructor 22 into the second operating configuration, thereby opening the associated valve, as shown by way of example in FIG. 7D.

Said second opening actuator 73 is preferably a linear actuator, preferably an oil-pressure one.

In particular, three passages are opened, preferably equally spaced, e.g. by 120°, through which drilling fluid "P" will be allowed to flow.

The operation and the technical features of valve assembly 2 illustrated in this embodiment are described in detail in the above-mentioned Italian patent application ITTO20130722.

After the first valve associated with the first obstructor 22 has been opened, drilling fluid "P", diverted into secondary circuit 12, can flow past the barrier formed by the first obstructor 22 because the first obstructor 22 has switched into the second operating configuration, thus removing the first barrier to the circulation of the fluids through radial aperture 19. The last barrier that needs to be removed in order to definitively establish the circulation of drilling fluid "P" through radial aperture 19 consists of a second obstructor 24, similar to the one described for the previous embodiment, as shown by way of example in FIG. 7D. As in the previous embodiment, the pressure difference at the ends of the second obstructor 24 allows said second obstructor 24 to move in order to open the second valve of valve assembly 2, thereby establishing the circulation of fluid "P" through radial aperture 19, as shown by way of example in FIG. 8. In this configuration, both obstructors (22, 24) are in the second operating configuration, which causes the two respective valves to stay open.

When the step of feeding the drilling fluid through radial aperture 19 is complete, by appropriately operating collector circuit 10 the flow of fluid "P" towards secondary circuit 12 is interrupted in order to simultaneously re-establish the circulation towards the main circuit 11. This pressure variation in proximity to radial aperture 19 causes the second obstructor 24 to return into the first operating configuration, thereby closing the associated valve and preventing circulation of the fluid through said radial aperture 19.

The second opening actuator 73 is then activated, thus stopping its action upon cams 222; in particular, said second opening actuator 73 is retracted, thereby allowing cams 222 to return into an initial idle position. Return means, such as springs, with which cams 222 themselves are equipped, contribute to the movement of cams 222 in addition to the elastic means comprised in coupling actuator 64 that presses on the first obstructor 22. The movement of the second opening actuator 73 leads to a configuration that is similar to the one shown in FIG. 7C.

Said translational movement of obstructor 22 closes at least partially the associated valve, thus bringing the same obstructor only partially into the first configuration.

Then opening actuator 72 is activated again and makes a rotation, preferably contrary to the direction of rotation taken for opening the first valve associated with the first obstructor 22. The closing of the first valve causes said first obstructor 22 to return into the first operating configuration, thus definitively closing radial aperture 19.

In this situation, the devices (6, 7) comprised in connection device 4 have come to an operating configuration that is substantially equivalent to the one shown in FIG. 7B.

Once the barrier consisting of the first obstructor 22 has been closed, coupling actuator 64 can be activated in order to retract fitting element 62 of clamping element 23 back into the initial configuration, e.g. as shown in FIG. 7A. Then clamping system 5 is activated in order to release drilling element 17, in particular by opening as in the previous embodiment.

Subsequently, through said handling system 3, opening device 4 is moved away from drilling element 17.

As in the previous embodiment, said clamping system 5, said coupling device 6 and said opening device 7 are activated and controlled by control unit 8 via said plurality of sensors 82, for the purpose of executing the above-described operating sequence.

FIGS. 9A-13 illustrate a third embodiment of connection device 4 according to the present invention. In the present embodiment, opening device 7 is adapted to selectively open and close said radial aperture 19 by acting upon said first obstructor 22 of valve assembly 2 by making a rototranslational movement. Furthermore, the coupling device and the opening device coincide. More in particular, the coupling actuator coincides with the opening actuator, which is made as a single actuating device (designated by reference numeral 75 in the drawings and in the following description).

In the present embodiment, said actuating device 75 is adapted to cause said fitting element 62 to make at least one rototranslational movement, in particular a continuous movement. In the present embodiment, said actuating device 75 is external, preferably totally external, to central body 42. In particular, said actuating device 75 is secured to support structure 50 above the second connection portion 44, with respect to a second axis "Z", through a fastening structure 751.

Said actuating device 75 is rotatably secured to the fastening structure 751 at a third pivot point 76, for the purpose of allowing the execution of a rototranslational movement. This solution turns out to be particularly simple, while offering the same performance as the previous embodiments.

The following will briefly describe the operating sequence for connecting, and then disconnecting, connection device 4 to/from drilling element 17. Those parts which are common to the previous embodiments will not be described in detail.

The step of bringing connection device 4 near the drilling element is effected by moving said connection device 3. Connection device 4, once it has arrived in the proximity of drilling element 17, clamps drilling element 17 by means of clamping system 5 and keeps the connection energized by pressing a gasket 442, as in the previous embodiments. This connection ensures hydraulic sealing, as shown by way of example in FIGS. 9B and 10B.

Substantially simultaneously with the tightening step, or at least before said tightening actuators 54 bring the system into a closed configuration, exerting a force on said arms 52 in order to energize the junction, the step of coupling fitting element 62 to clamping element 23 of the first obstructor 22 of valve assembly 2 is carried out. In the present embodiment, fitting element 62 is shaped like a pin to be inserted into and removed from clamping element 23, which is shaped like a housing preferably complementary to said fitting element 62.

Clamping element 23 faces a groove 192 comprised in the walls of drilling element 17. Said groove 192 follows the circular profile of the outer wall of drilling element 17. Said actuating device 75 is activated by control unit 8 as a function of the data obtained from said plurality of sensors 82, so as to be moved in a manner such as to allow said fitting element 62 to be aligned, during the tightening step, with said clamping element 23 of the first obstructor 22. Said fitting element 62 is movably secured to the actuating device, in particular comprising a damping element 752. Said damping element 752 is so designed as to allow fitting element 62 to move along its longitudinal axis, for the purpose of allowing it to be properly positioned and generating a force that will keep the same fitting element 62 in contact with clamping element 23, as clearly shown in FIGS. 10A, 10B, 11B and 12B.

Said actuating device 75 is a linear actuator, preferably an oil-pressure one, rotatably mounted about the third pivot point 76 on said fastening structure 751, so that actuating device 75 can cause fitting element 62, and hence also the first obstructor 22, to make a rototranslational movement, preferably in a continuous manner.

Said groove 192 on which said clamping element 23 abuts has a segmented-line shape comprising two tracts that are transversal to both the longitudinal first axis "X" of connection device 4 and the vertical second axis "Z", and one tract that is inclined relative to such axes and joins them.

After clamping system 5 has been tightened to drilling element 17 and fitting element 62 has been substantially simultaneously fitted to clamping element 23, said actuating device 75 is activated in order to cause the first obstructor 22 to make a rototranslational movement.

Due to the shape of said groove 192, actuating device 75, when it is activated for either retracting or extending, will also make a rotary movement about said third pivot point 76, in particular a rotation about an axis parallel to axis "X", thus causing fitting element 62, and hence said first obstructor 22, to make a rototranslational movement. During the opening step, said actuating device 75 makes a linear movement, thus getting shorter. During the rototranslational movement made by actuating device 75, fitting element 62 and hence said first obstructor 22 are moved up to an end-of-travel point. Said end-of-travel point is preferably defined by the same groove 192.

The rototranslational movement of the first obstructor 22 causes it to switch into the second operating configuration, thereby opening a first valve with which the same first obstructor 22 is associated, thus partially opening said radial aperture 19. The movement of the second obstructor 22 causes a hole provided in obstructor 22 itself to face, preferably to become aligned with, radial aperture 19, with reference to axis "X", through which aperture drilling fluid "P" will be allowed to flow.

The operation and the technical features of valve assembly 2 illustrated in this embodiment are described in detail in the above-mentioned Italian patent application ITTO20130722.

After the opening step, drilling fluid "P", diverted into secondary circuit 12, can flow past the first valve because the first obstructor 22 has switched into the second operating configuration, thus removing the first barrier to the circulation of the fluids through radial aperture 19. The last barrier that needs to be removed in order to definitively establish the circulation of drilling fluid "P" through radial aperture 19 consists of a second obstructor 24, e.g. a non-return valve similar to the one described with reference to the previous embodiments, as shown by way of example in FIGS. 10B, 11B and 12B. The pressure difference at the ends of said second obstructor 24 allows said second obstructor 24 to move in order to open a second valve of valve assembly 2, thereby allowing fluid "P" to circulate through radial aperture 19.

When the step of feeding the drilling fluid through radial aperture 19 is complete, actuating device 75 is activated again, making a linear movement, in particular extending, for the purpose of bringing the first obstructor 22 into the first operating configuration, thereby closing a first valve with which the same first obstructor 22 is associated. While making this linear movement, said actuating device 75 drags said first obstructor 22, causing it to make a rototranslational movement. In fact, because of the shape of groove 192 and the rotation of actuating device 75 about the third pivot point 76, the linear movement allows fitting element 62 to make a rototranslational movement that allows closing the first valve with which said first obstructor 22 is associated. The closing of the first valve simultaneously causes the second valve to close as well, bringing the second obstructor 24 into the first operating configuration. In this situation, actuating device 75 comprised in connection device 4 has come into an operating configuration that is substantially equivalent to the one shown in FIGS. 11A and 11B.

Being both valves closed, with which the two obstructors are respectively associated, said radial aperture 19 is definitively closed. Clamping system 5, and in particular tightening actuators 54, are then activated in order to release drilling element 17, in particular by opening. Simultaneously with the release of drilling element 17 effected by clamping system 5, fitting element 62 is separated from clamping element 23.

Subsequently, through said handling system 3, opening device 4 is moved away from drilling element 17.

As in the previous embodiment, said clamping system 5, said coupling device 6 and said opening device 7 are enclosed in a single actuating device 75, and are activated and controlled by control unit 8 via said plurality of sensors 82, for the purpose of executing the above-described operating sequence.

In an alternative embodiment (not shown) of the third embodiment described herein, also the rotary movement about the third pivot point 76 is carried out through an actuator adapted to control the rotation of actuating device 75 about the third pivot point 76.

Connection device 4 according to the present invention performs the function of controlling the opening and closing of the valve assembly, in particular of at least one obstructor, in particular the outermost one of the valve assembly, and of ensuring the supply of drilling fluid "P", coming from a secondary circuit 12 connected to collector circuit 10, into drilling elements 17, such as a set of drill pipes, when connecting/disconnecting each drilling element 17 having the desired drill length.

The peculiar feature of connection device 4 according to the present invention is the high level of automation that allows the same device to be monitored and controlled remotely, e.g. from the dog-house.

The development of an automatic or semiautomatic connection device 4 aims, in fact, at reaching a high level of safety that will make drilling rigs increasingly safe even in environments where there are strong restrictions to the utilization of personnel for manual tasks in risk areas on the drill floor.

The device according to the present invention can be easily manufactured, and offers a high level of operating and safety performance.

Connection device 4 is particularly suitable for being included in a drilling rig for drilling high-pressure wells, high-temperature wells and/or deepwater wells, where working conditions are most critical.

REFERENCE NUMERALS

| | |
|---|---|
| Drilling rig | 1 |
| Collector circuit | 10 |
| Main circuit | 11 |
| Secondary circuit | 12 |
| Drilling element | 17 |
| Guides | 170 |
| Retaining flange housings | 171 |
| Axial hole | 18 |
| Radial aperture | 19 |
| Grooves | 192 |
| Valve assembly | 2 |
| Valve body | 21 |
| First obstructor | 22 |
| Cam | 222 |
| Clamping element | 23 |
| Seats | 232 |
| Second obstructor | 24 |
| Handling system | 3 |
| Connection device | 4 |
| Intake duct | 41 |
| Support elements | 412 |
| Central body | 42 |
| First connection portion | 43 |
| Second connection portion | 44 |
| Gaskets | 442 |
| Retaining flange | 45 |
| Clamping system | 5 |
| Support structure | 50 |
| Housing portion | 51 |
| Arm | 52 |
| Tightening actuator | 54 |
| First pivot point | 55a |
| Second pivot point | 55b |

-continued

| | |
|---|---|
| Protuberances | 56 |
| Coupling device | 6 |
| Outer casing | 60 |
| Fitting element | 62 |
| Protrusion | 621 |
| Coupling actuator | 64 |
| Elastic means | 66 |
| Opening device | 7 |
| Joint | 70 |
| Opening actuator | 72 |
| Second opening actuator | 73 |
| Actuating device | 75 |
| Fastening structure | 751 |
| Damping element | 752 |
| Third pivot point | 76 |
| Control system | 8 |
| Sensors | 82 |
| Data processing unit | 84 |
| Fluid flow | "P" |
| First longitudinal axis | "X" |
| Second axis | "Z" |
| Drilling well | "h" |

The invention claimed is:

1. A connection device for connecting a secondary circuit for circulation of drilling fluids to a drilling element comprising an axial hole and a radial bore in communication with said axial hole; a safety valve assembly associated with said radial bore, the safety valve assembly comprises a valve body and at least one obstructor for taking at least two operating configurations;

said connection device comprises:

a central body comprising:

a first connection portion for effecting a sealed connection to said secondary circuit;

a second connection portion for effecting a sealed connection to said radial bore;

an intake duct, interposed between said connection portions, for conducting said drilling fluids;

a clamping system, for connecting the connection device to the drilling element;

only one opening device for selectively opening and closing, at least partially, the radial bore by acting upon the valve assembly;

only one coupling device for connecting said opening device to said valve assembly;

wherein:

said opening device is adapted to selectively open and close, at least partially, said radial bore by acting upon a first obstructor of the valve assembly through at least one rotary movement;

said coupling device is for coupling to a clamping element comprised in the first obstructor, so that said the at least one rotary movement of said opening device is transferred to said first obstructor in order to selectively open and close, at least partially, said radial bore in a secure manner.

2. The connection device according to claim 1, wherein said intake duct faces towards the radial bore of the drilling element and axially aligned therewith.

3. The connection device according to claim 1, wherein said clamping system comprises:

a housing portion for housing, at least partially, said drilling element;

at least one arm for encircling said drilling element, keeping said drilling element abutted in said housing portion and preventing said drilling element from moving;

at least one tightening actuator for moving said at least one arm in order to exert a force on said drilling element and keep said drilling element in abutment.

4. The connection device according to claim 3, comprising two of said at least one arm, one of said at least one tightening actuator being associated with each one of said arms.

5. The connection device according to claim 1, wherein said coupling device comprises:

a fitting element to be coupled to a corresponding clamping element on said first obstructor;

a coupling actuator for moving said fitting element.

6. The connection device according to claim 5, wherein said coupling actuator coincides with an opening actuator, configured as a single actuating device.

7. The connection device according to claim 1, wherein said opening device comprises: at least one first opening actuator for causing said coupling device to make the at least one rotary movement.

8. The connection device according to claim 7, wherein said at least one first opening actuator is adapted to cause a fitting element to make the at least one rotary movement.

9. The connection device according to claim 8, comprising at least one second opening actuator for causing said fitting element to make at least one translational movement.

10. The connection device according to claim 1, wherein said opening device comprises a first opening actuator for causing said coupling device to make at least one rotary movement.

11. The connection device according to claim 1, wherein said coupling device and said opening device are arranged inside the central body.

12. The connection device according to claim 1, wherein said coupling device and said opening device are arranged externally to the central body.

13. The connection device according to claim 1, comprising a control system for automatically controlling the connection device, comprising:

a plurality of sensors for detecting a plurality of physical quantities, including distance, pressure, movements, rotations, relating to at least one device comprised in the connection device;

at least one data processing unit for processing the data obtained from said plurality of sensors for automatically controlling and activating the devices in the connection device.

14. A system comprising:

the connection device according to claim 1, connected to the secondary circuit for circulation of drilling fluids;

said system being adapted for controlling circulation of drilling fluids in a drilling rig;

wherein:

said valve assembly is adapted to selectively open and close the radial bore located on the drilling element; comprising a valve body and at least two obstructors, arranged in cascade along a direction followed by the drilling fluids, each one of the obstructors being adapted to take at least two operating configurations;

said connection device is adapted to selectively open and close, at least partially, said radial bore by acting upon a first obstructor of the valve assembly.

15. The system according to claim 14, wherein the drilling rig comprises:

a fluid circulation circuit, the fluid circulation circuit comprising a main circuit and a collector circuit.

* * * * *